US007922350B1

(12) United States Patent
Siu

(10) Patent No.: US 7,922,350 B1
(45) Date of Patent: Apr. 12, 2011

(54) TACTICAL ILLUMINATOR

(75) Inventor: Cavan Siu, Hudson, NH (US)

(73) Assignee: L-3 Insight Technology Incorporated, Londonderry, NH (US)

( * ) Notice: Subject to any disclaimer, the term of this patent is extended or adjusted under 35 U.S.C. 154(b) by 258 days.

(21) Appl. No.: 12/117,017

(22) Filed: May 8, 2008

Related U.S. Application Data

(60) Provisional application No. 60/916,628, filed on May 8, 2007.

(51) Int. Cl.
*F21L 4/00* (2006.01)
*H01H 19/46* (2006.01)

(52) U.S. Cl. ..... 362/206; 362/202; 200/60

(58) Field of Classification Search ..... 362/202, 362/205, 206; 200/4, 14, 60
See application file for complete search history.

(56) References Cited

U.S. PATENT DOCUMENTS 7,281,815 B1 * 10/2007 Gustafson et al. ..... 362/206
RE40,125 E * 3/2008 Matthews et al. ..... 200/4
7,441,920 B2 * 10/2008 Kang et al. ..... 362/205
7,581,848 B1 * 9/2009 Parsons et al. ..... 362/206

* cited by examiner

*Primary Examiner* — Jong-Suk (James) Lee
*Assistant Examiner* — Peggy A. Neils

(57) ABSTRACT

A plurality of actuators allow an operator to control the status of an illuminator. Rotation of one of the actuators either prevents the illuminator from illuminating, allows an operator to selectively illuminate a person or area of interest with a second actuator, or maintains illumination without maintaining an applied force.

20 Claims, 11 Drawing Sheets

| | | Tail Cap | | Remote |
|---|---|---|---|---|
| **Operational State** | **Position** | **MOM1** | **SW#1** | **MOM2** |
| "Mechanical lock out" (No light output) | P1 | Open | Open | No effect |
| "Momentary" (Light output when actuated) | P2 | Closed when a force F1 is applied | Closed | Momentary on when a force F2 is applied |
| "Mechanical lock ON" (Constant light output) | P3 | Closed | Open or Closed | No effect |

FIGURE 4

TACTICAL ILLUMINATOR

CROSS REFERENCE TO RELATED APPLICATIONS

The present application claims the benefit of Provisional Patent Application Ser. No. 60/916,628, filed May 8, 2007, the entire disclosure of which is incorporated herein by reference in its entirety.

BACKGROUND OF THE INVENTION

Handheld flashlights and tactical illuminators have been used to effectively see a target or area of interest. These devices typically have a source of illumination, for example an incandescent lamp or light emitting diode (LED), to provide general illumination of an area or person of interest, and are powered by one or more batteries. The output is typically a white light capable of projecting 40 to 150 lumens, although higher output lights and different colored lights are known. Some tactical illuminators have a laser to assist in aiming of the weapon.

Tactical illuminator may be attached to a weapon, for example a handgun, long gun, or shotgun, in a variety of different ways. Some tactical illuminators are secured to a handgun having a set of rails located under the barrel, in an area forward of the trigger guard, and some tactical illuminators are secured to the trigger guard.

These devices typically have one or more actuators to turn the light and/or laser on or off, select a lamp to be illuminated, or adjust the brightness.

BRIEF DESCRIPTION OF THE DRAWINGS

For a better understanding of the present invention, together with other objects, features and advantages, reference should be made to the following detailed description which should be read in conjunction with the following figures wherein like numerals represent like parts:

FIG. 4 is chart showing operation of an illuminator consistent with one embodiment of the invention.

DETAILED DESCRIPTION OF THE EMBODIMENTS

Figure 1A:
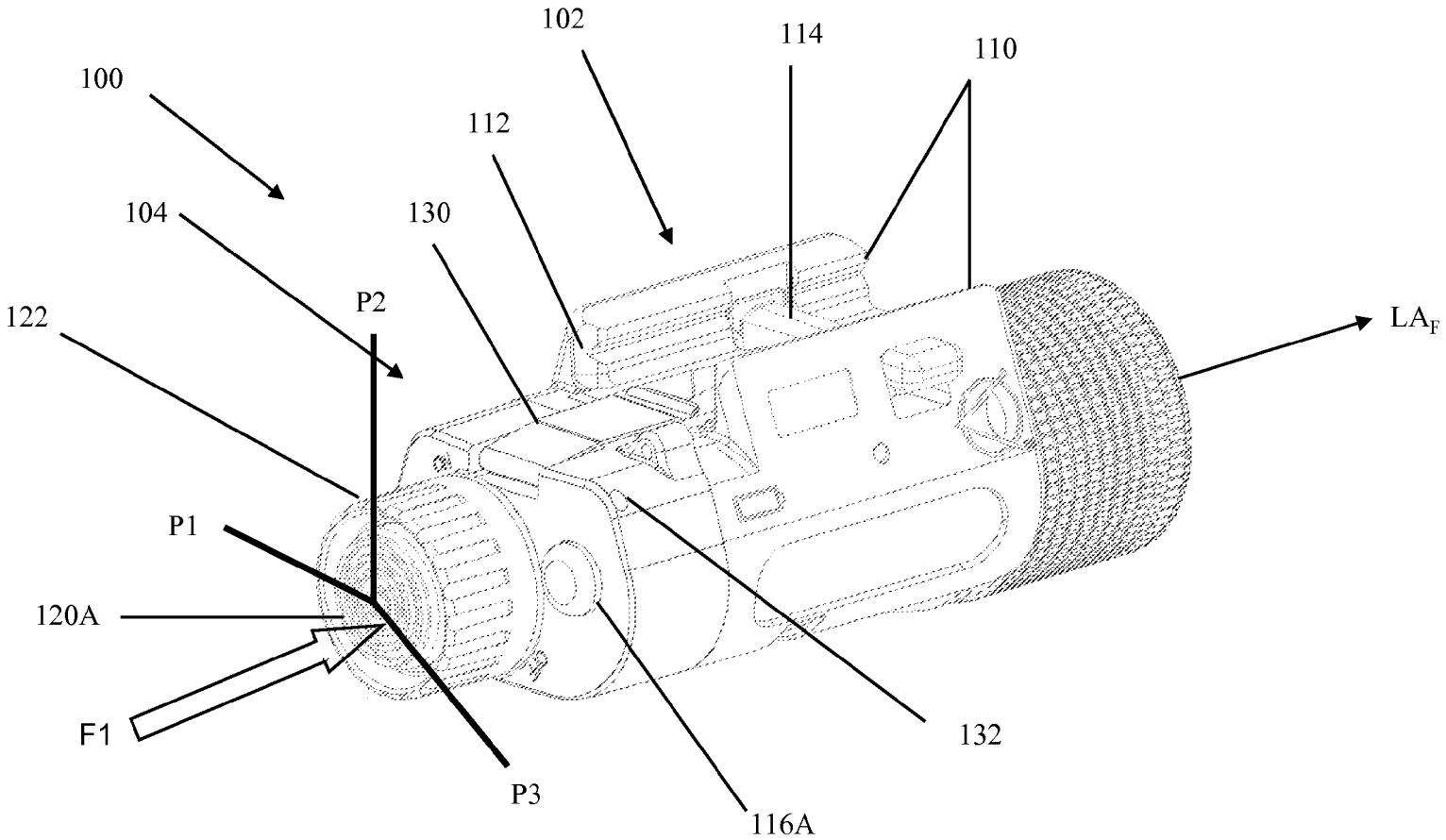
FIG. 1A is a perspective view of a first illuminator consistent with one embodiment of the invention.
Figure 2:
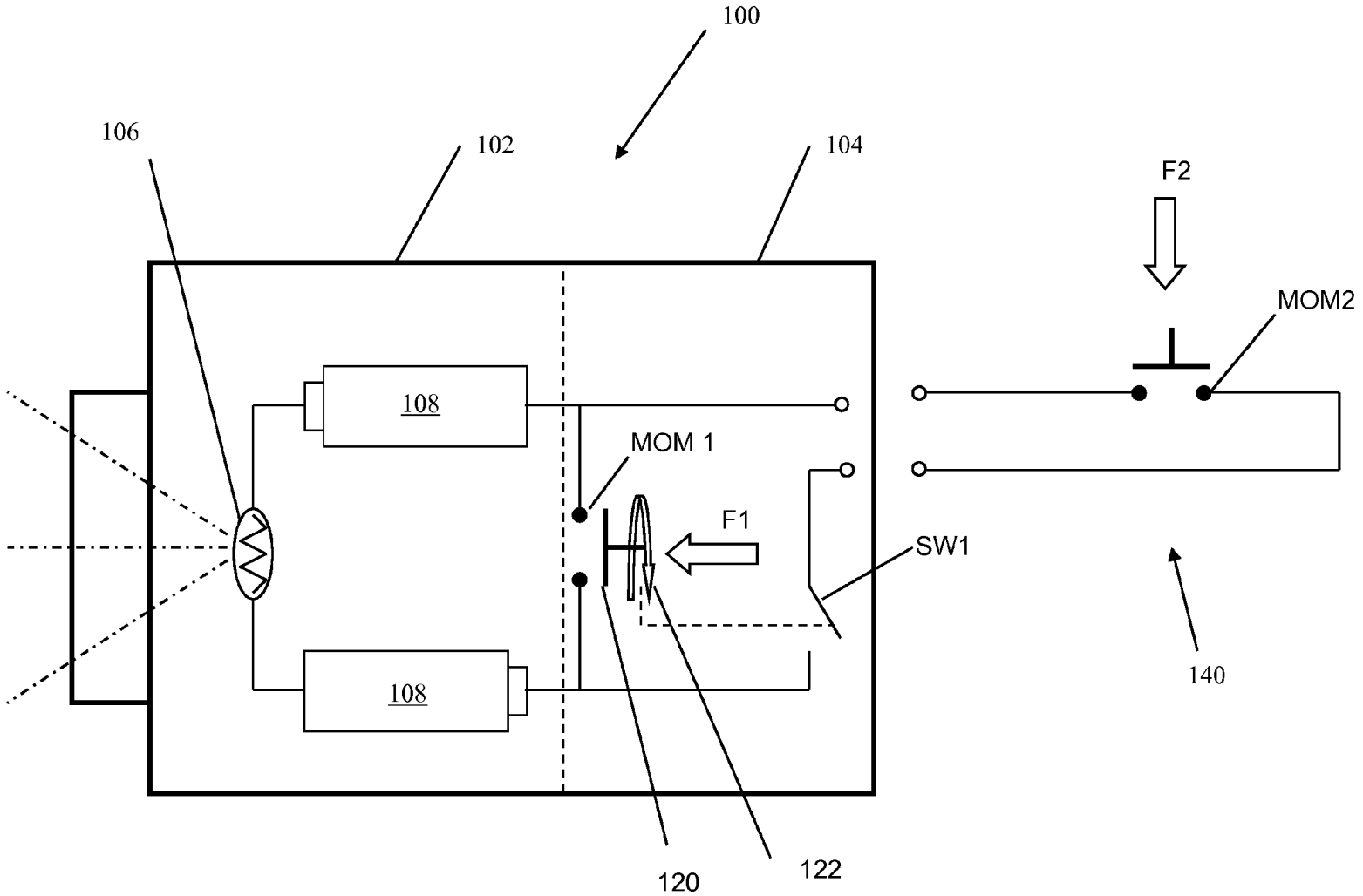
FIG. 2 is a schematic of an illuminator consistent with one embodiment of the invention.

FIG. 1A is a perspective view of a first illuminator 100 consistent with one embodiment of the invention and FIG. 2 is a schematic of an illuminator consistent with one embodiment of the invention. The illuminator 100 may have a housing 102 including a tail cap assembly 104 to hold and to protect internal components from unintended contact or debris. The housing 102 may be coupled to a weapon with a suitable attachment mechanism, for example a rail grabber, slide-lock® mechanism, or other clamp. The illuminator 100 may have an incandescent, LED or other light source 106 powered by at least one battery 108 or other power source enclosed at partially in the housing 102 having generally parallel elongated rigid projections 110 extending generally parallel to a longitudinal axis LAF. The elongated projections 110 may have a contoured inner surface 112 having concave and convex surfaces that are configured to allow sliding action along a longitudinal axis with a cooperating rail mounting structure, for example a Weaver or MIL-STD-1913 rail. The elongated projections 110 may be spaced a fixed distance from each other. The flashlight 100 may include a spring biased bar 114 configured to cooperate with a cross slot in a cooperating rail mounting structure to allow the user to quickly attach/detach the flashlight to/from the rail mounting structure. The illuminator 100 may be coupled to the cooperating rail structure in a variety of different ways. For example, the illuminator may utilize the spring-biased mechanism disclosed in issued U.S. Pat. No. 6,574,901, or a conventional rail or trigger guard clamping mechanism.

The tail cap assembly 104 may be coupled to the housing 102 with a retainer 130. The retainer 130 may be secured to the tail cap assembly 104 by a retainer pin 132 that may be rotatable about an axis perpendicular to the longitudinal axis LAF of the housing 102. Alternatively, a retainer may be secured to the housing by a retainer pin.

Figure 6:
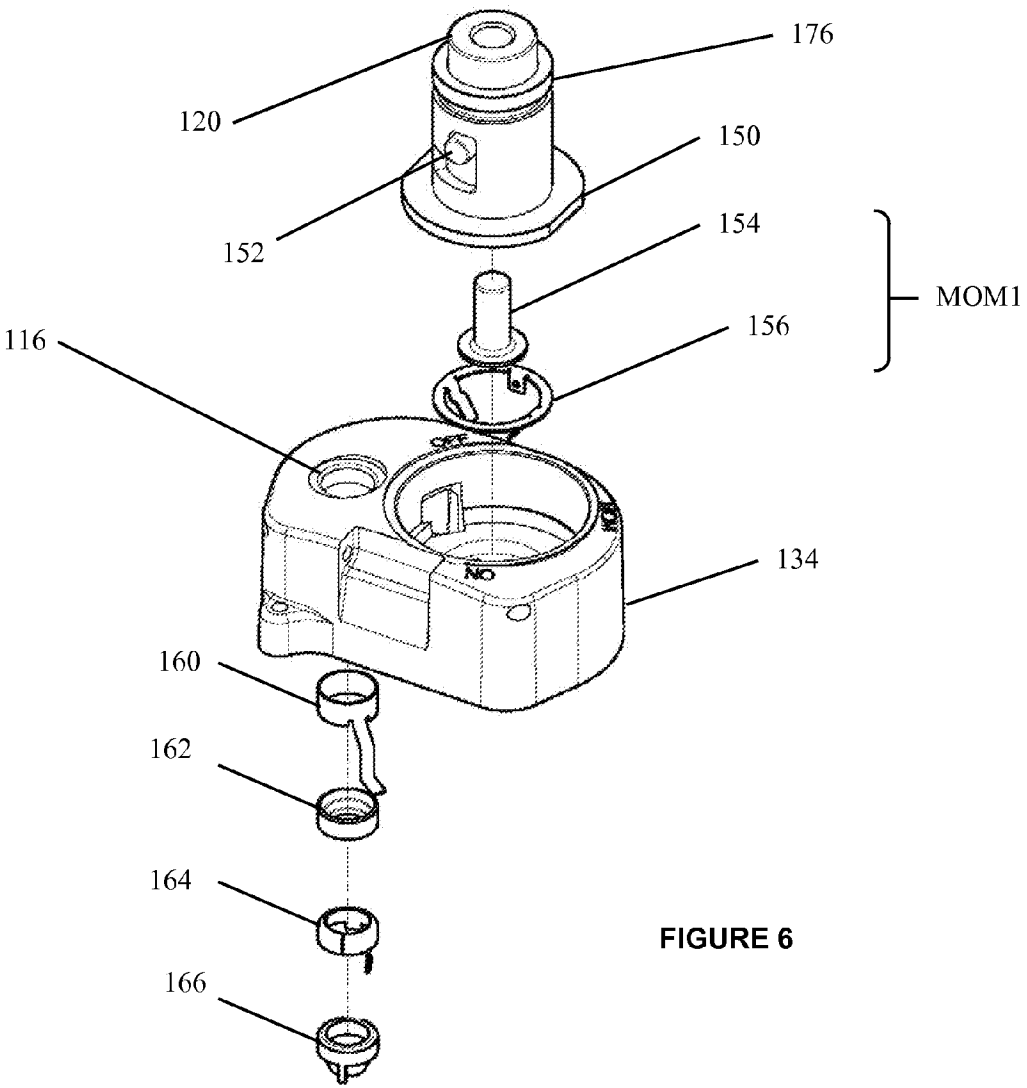
FIG. 6 is a second exploded view of the tail cap assembly of FIG. 5 consistent with one embodiment of the invention.

The tail cap assembly 104 may include a first actuator 120 (see FIG. 6) and a second actuator 122 for controlling the status (on, off, brightness, color, blink rate) of the light source 106 and a remote jack 116 to allow a wired remote 140 to be plugged in. The first actuator 120 may be sealed to the second actuator 122 with an actuator membrane 120A. The remote jack 116 may be sealed with a plug 116A.

Figure 3:
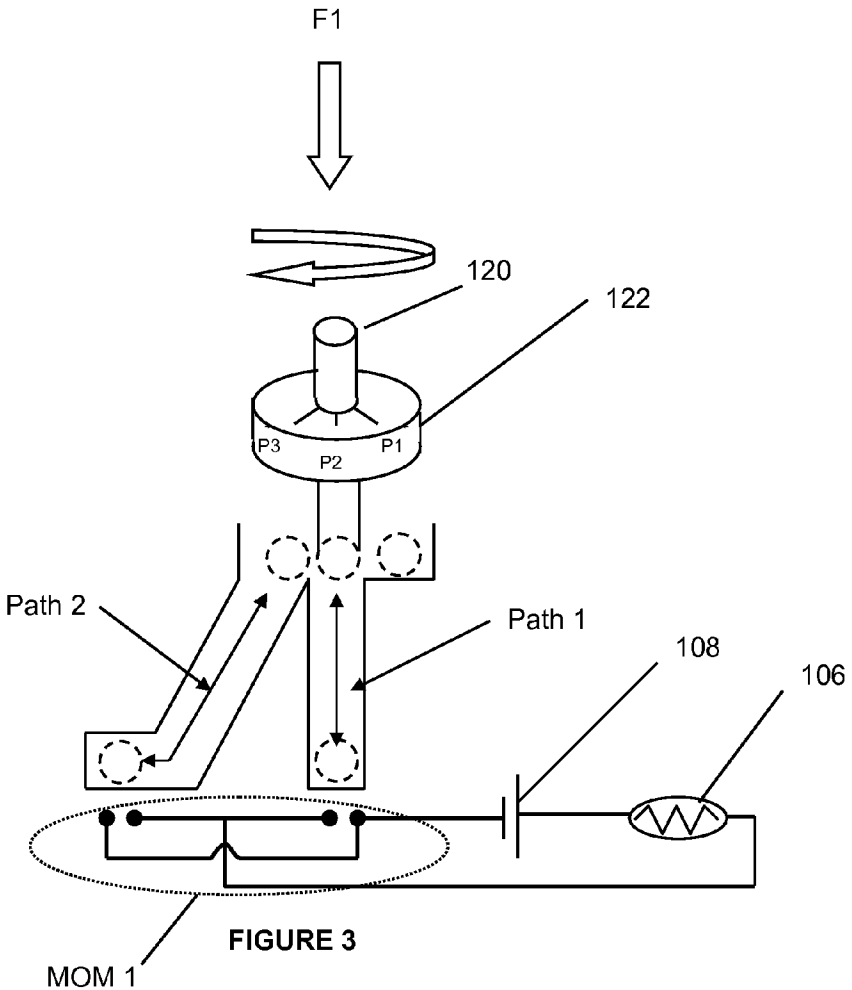
FIG. 3 is an illustration showing operation of switch actuators consistent with one embodiment of the invention.

FIG. 3 is an illustration showing operation of switch actuators consistent with one embodiment of the invention and FIG. 4 is chart showing operation of an illuminator consistent with one embodiment of the invention. The first actuator 120 may be linearly translatable parallel to the longitudinal axis LAF and the second actuator may be rotatable about an axis parallel to the longitudinal axis LAF. The actuators 120, 122 may be configured to actuate a first switch MOM1 and a second switch SW1 in the tail cap assembly 104 to change the status of the source of illumination 106.

The first actuator 120 may be movable between a first position in which the first switch MOM1 does not complete a circuit with battery 108 and the source of illumination 106 and a second position in which the first switch MOM1 completes a circuit with the battery 108 and the source of illumination 106. First switch MOM1 may be actuated by actuator 120. In the first position the first actuator 120 may be biased outward by a spring 138 and an axial force F1 may be required to move the actuator 120 to the second position.

The second actuator 122 may be moveable from a first position P1 to a second position P2 and a third position P3. The second actuator 122 may be configured to prevent movement of the first actuator 120 from the first position when the second actuator 122 is in the first position P1. The second actuator 122 may be configured to allow movement of the first actuator 120 from the first position to the second position when the second actuator 122 is in the second position P2. The second actuator 122 in the third position may be configured to maintain the first actuator 120 in the second position. The first actuator 120 and the second actuator 122 may be configured such that they can be rotated or translated without disconnecting the tail cap assembly 104 from the housing 102.

Second switch actuator 122 may be rotated to position P1 in which actuator 120 is mechanically locked out, i.e. the first actuator 120 cannot be actuated to complete a circuit with the at least one battery 108 and the source of illumination 106. In position P1, the momentary switch MOM1 is open and the switch SW1 is open. In this position, the operator cannot change the status of the source of illumination at the tail cap assembly 104 or through the remote 140. This position (P1) may be chosen by an operator when the illuminator 100 is stored in a backpack to prevent the batteries from being drained or when the operator is on a mission and does not want to chance accidental actuation.

Second switch actuator 122 may be rotated to position P2 in which actuator 120 may be manually actuated along Path 1 to momentarily (as long as the operator applies a force F1 to the first actuator 120 or a force F2 to third switch MOM2 in the remote 140) complete a circuit with the at least one battery 108 and the source of illumination 106. In position P2, the momentary switch MOM1 is closed when a force F1 is applied and the switch SW1 is closed. In this position, the operator can selectively change the status of the source of illumination at the tail cap assembly 104 by applying a force F1 and through the remote 140 by applying a force F2. This position (P2) may be chosen by an operator to selectively turn the illuminator ON and OFF.

Second switch actuator 122 may be rotated to position P3 in which actuator 120 is mechanically locked ON, i.e. the first actuator 120 maintains a complete circuit with the at least one battery 108 and the source of illumination 106. As second actuator 122 is rotated, the first actuator 120 travels along Path 2 and is locked in position. In position P3, the momentary switch MOM1 is closed and the switch SW1 can either be open or closed. In this position the illuminator is maintained ON. This position (P3) may be chosen by an operator when the operator desires the illuminator to turn ON and stay ON without having to apply a force F1 or F2.

Figure 1B:
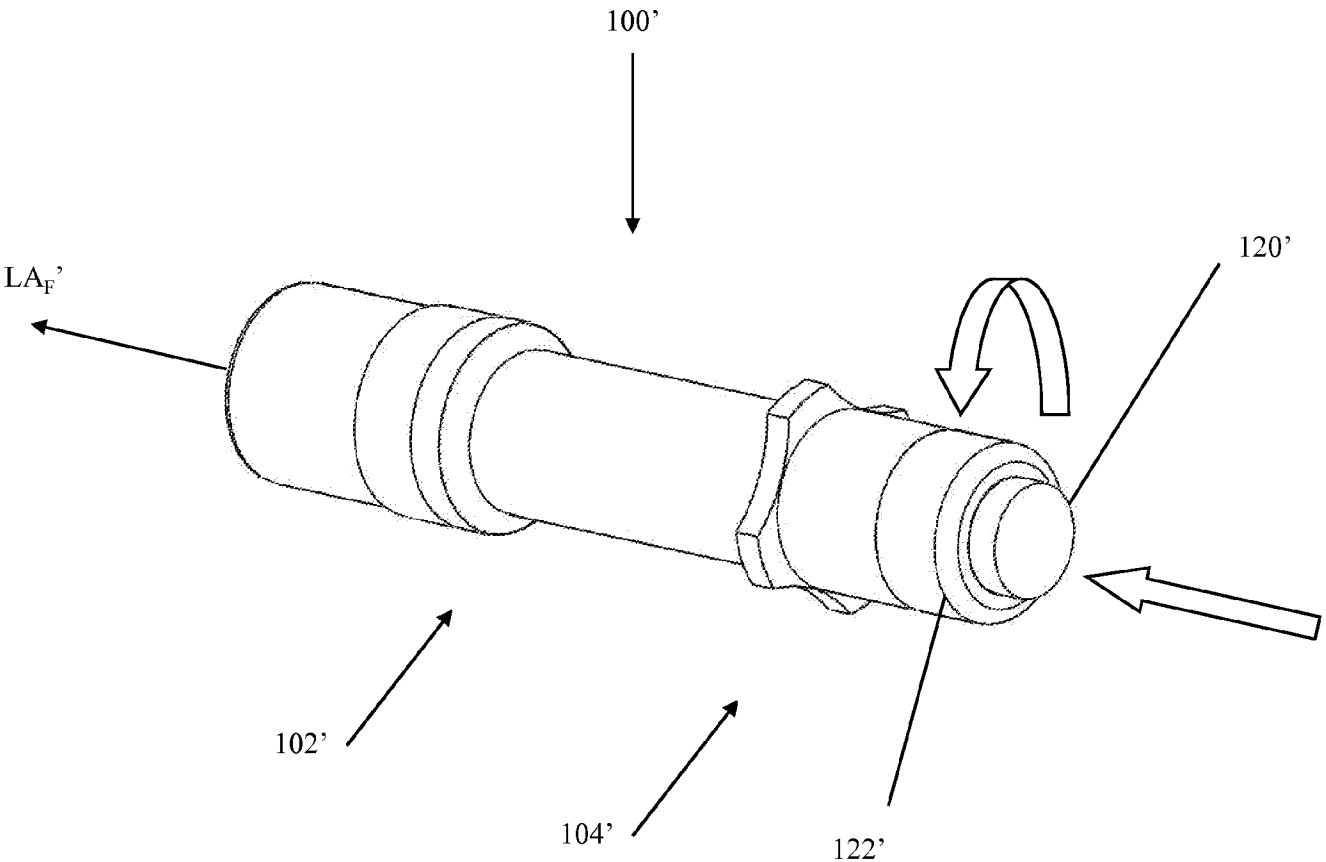
FIG. 1B is a perspective view of a second illuminator consistent with one embodiment of the invention.

FIG. 1B is a perspective view of a second illuminator 100' consistent with another embodiment of the invention. The illuminator 100' may be a handheld flashlight having a housing 102' having a longitudinal axis LAF' and a tail cap assembly 104'. The tail cap assembly 104' may have a first actuator 120' and a second actuator 122'. The first actuator 120' and the second actuator 122' may be configured such that they can be rotated without disconnecting the tail cap assembly 104' from the housing 102'. The first actuator 120' and the second actuator 122' may operate similar to actuators 120, 122 respectively.

Figure 5:
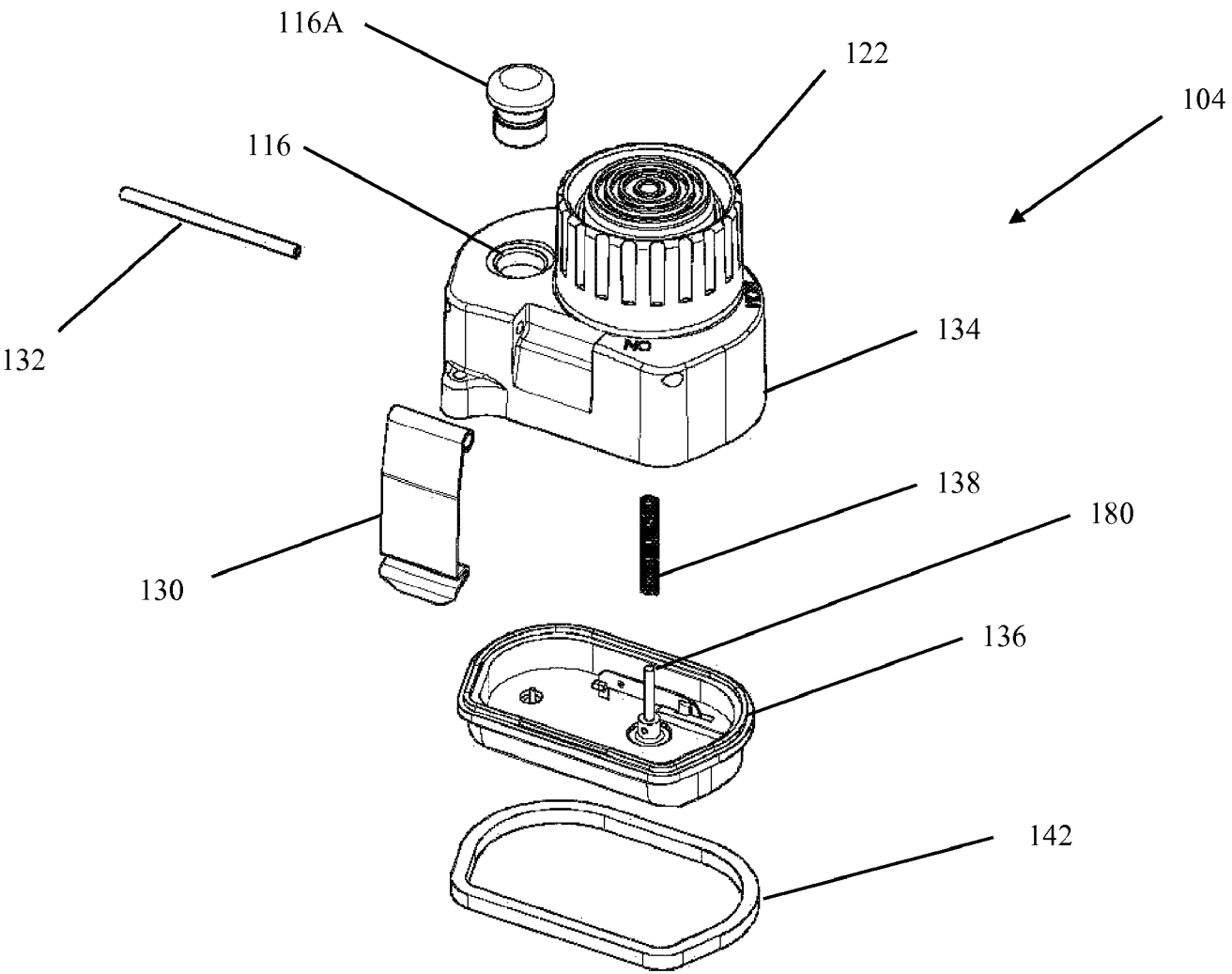
FIG. 5 is a first exploded view of a tail cap assembly consistent with one embodiment of the invention.
Figure 10:
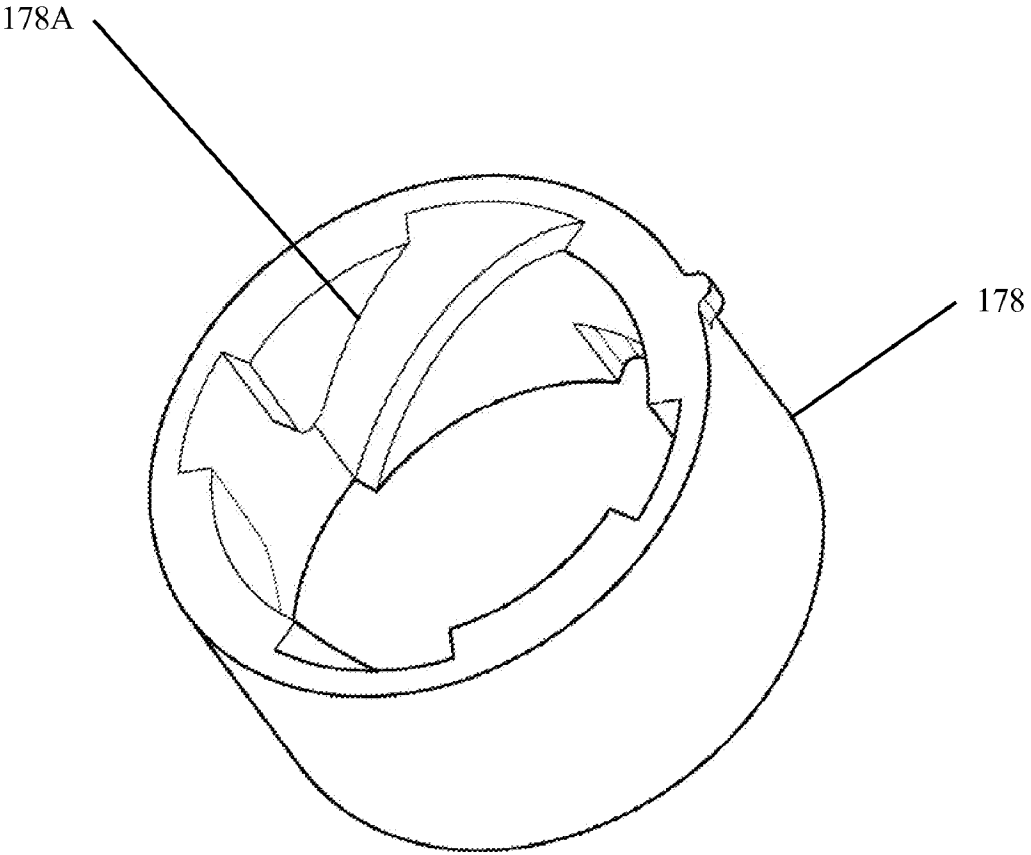
FIG. 10 is a view of a component of the tail cap assembly of FIG. 5.
Figure 11:
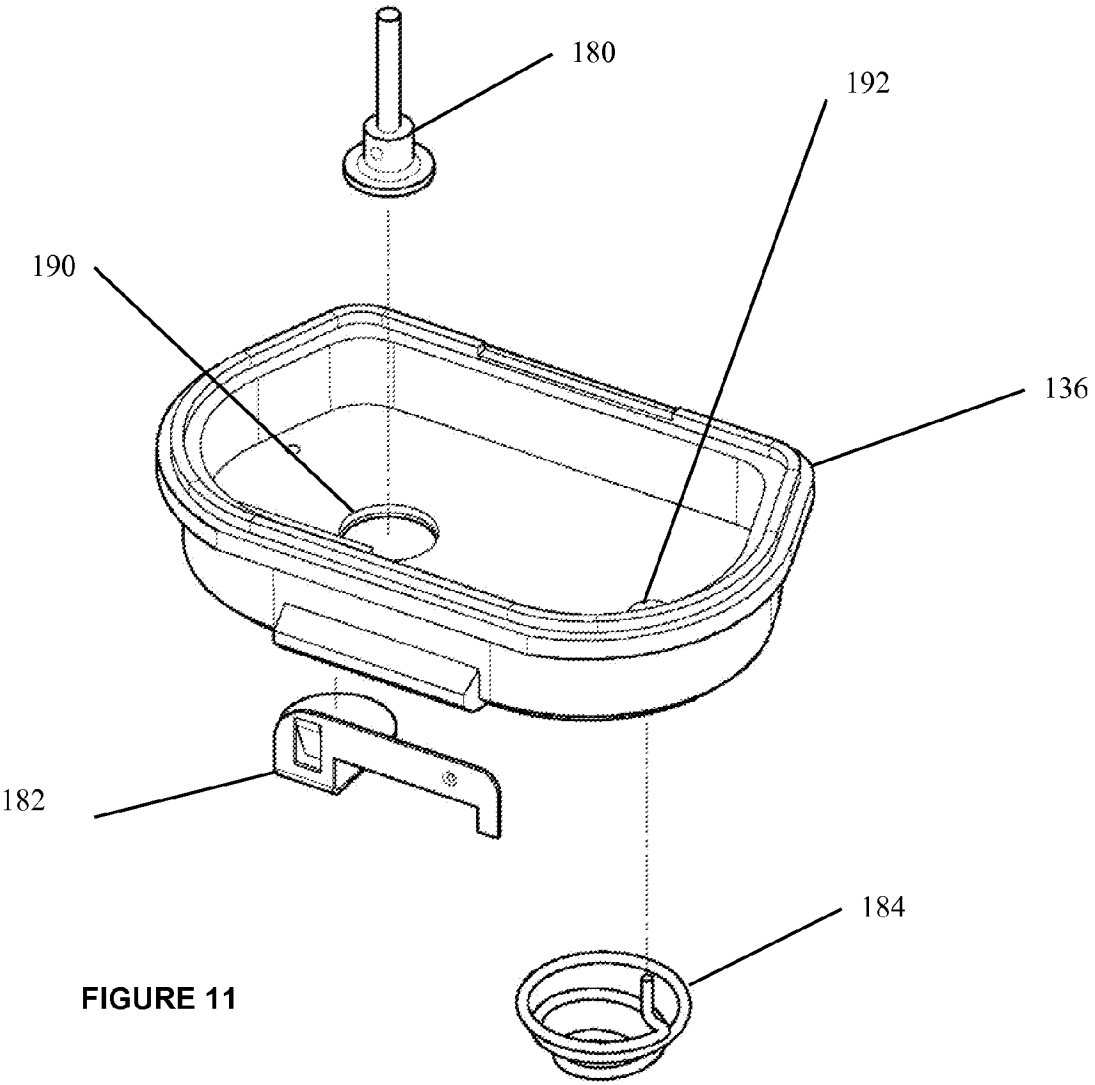
FIG. 11 is a sixth exploded view of the tail cap assembly of FIG. 5 consistent with one embodiment of the invention.

FIGS. 5, 6, 7, 8, 9, and 11 are multiple exploded views of the tail cap assembly of FIG. 5 consistent with one embodiment of the invention and FIG. 10 is a view of a component of the tail cap assembly of FIG. 5. The tail cap assembly 104 may have a first cover portion 134 coupled to a second cover portion 136 to form a watertight seal to a depth in excess of 60' and the tail cap assembly 104 may be coupled to the housing 102 with a gasket 142 to form a watertight seal for the illuminator 100. The first actuator 120 may be inserted in a button housing 150 and then secured in place with a shaft 152. A contact 154 may be coupled to the end of the first actuator 120. When the first actuator 120 is actuated, the contact 154 contacts a contact plate 156 to complete a circuit with the at least one battery 108 and the source of illumination 106.

Figure 8:
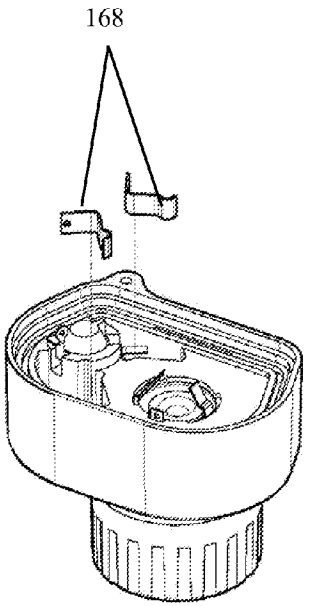
FIG. 8 is a fourth exploded view of the tail cap assembly of FIG. 5 consistent with one embodiment of the invention.

A positive contact 160, a spacer 162, a negative contact 164, and a cap jack 166 may be aligned with the remote jack 116 and selectively electrically coupled to detent contacts springs 168 (see FIG. 8). Detent contact springs 168 and contact ring 170 (see FIG. 9) may make up third switch MOM2 and selectively provide a conductive path to the remote switch 140.

Figure 7:
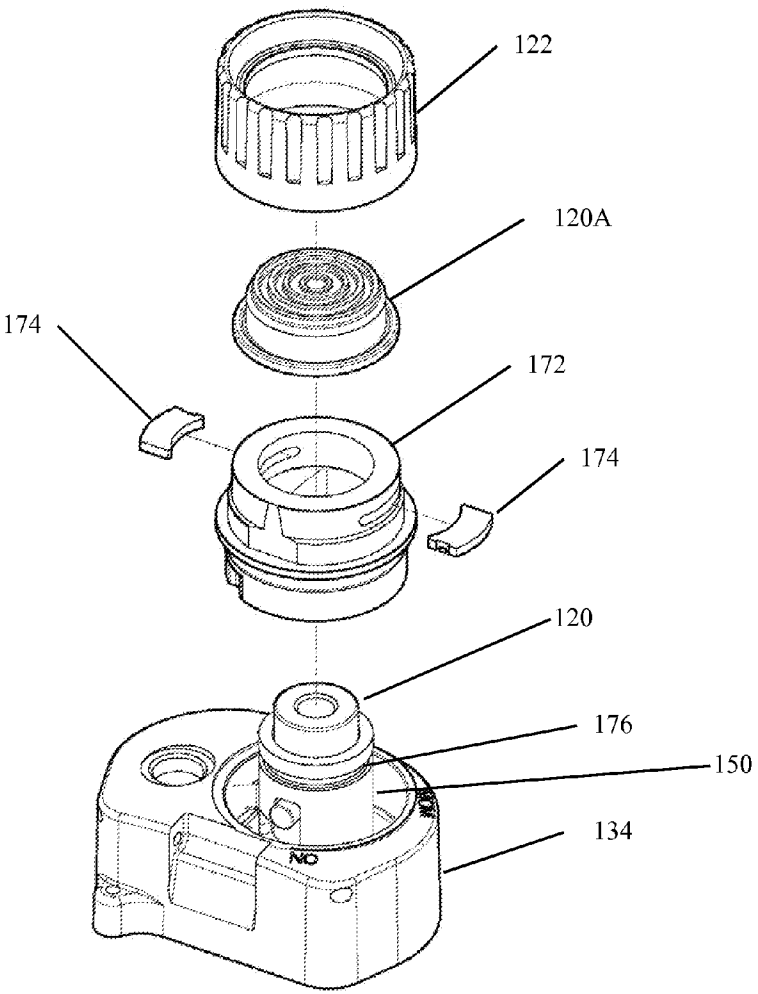
FIG. 7 is a third exploded view of the tail cap assembly of FIG. 5 consistent with one embodiment of the invention.
Figure 9:
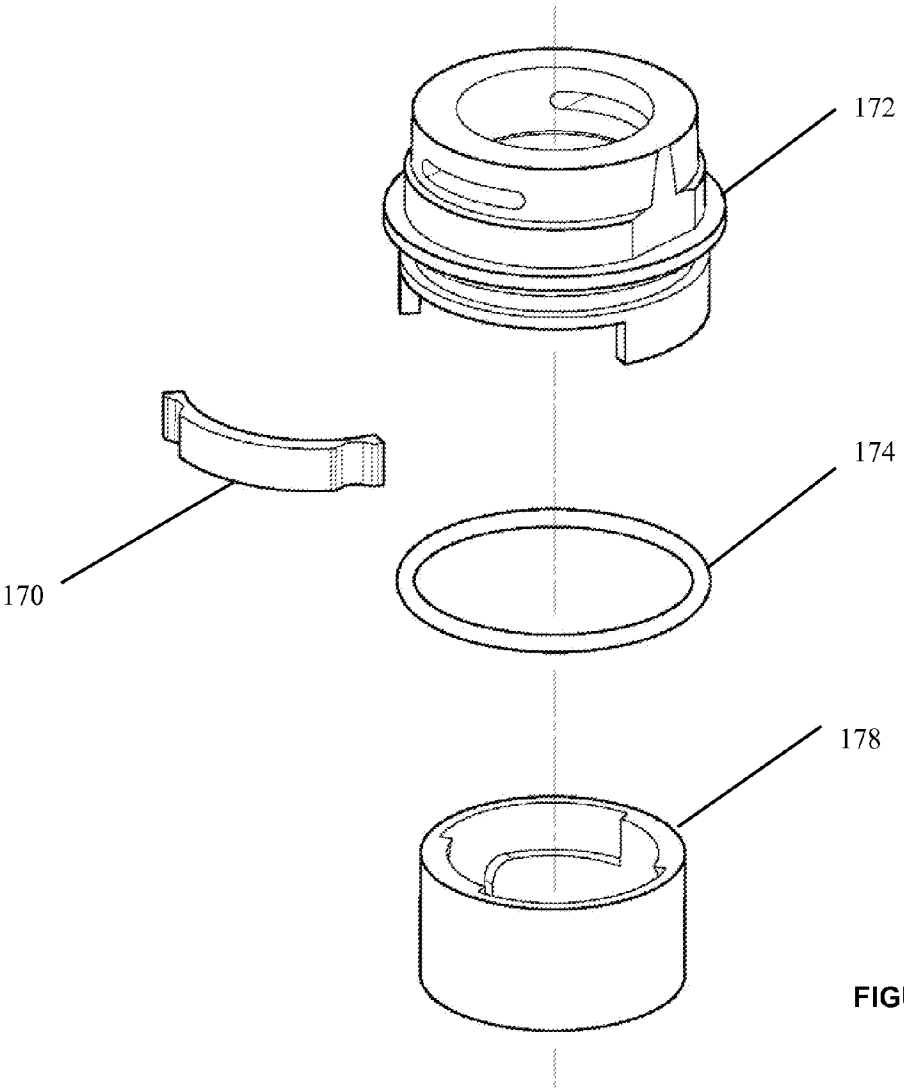
FIG. 9 is a fifth exploded view of the tail cap assembly of FIG. 5 consistent with one embodiment of the invention.

As shown in FIG. 7, a rotary housing 172 may be placed over the first actuator 120 and the button housing 150 and secured with button stops 174 that cooperate with a circumferential groove 176 in the button housing 150 to prevent linear movement. Second actuator 122 may be coupled to the rotary housing 172, for example with an adhesive bond.

The rotary housing 172 may be coupled to a rotary track 178 with an O-ring 174 therebetween and the contact ring 170 may be coupled to the rotary housing 172. The rotary track 176 may have an internal groove 178A that cooperates with the shaft 152 to translate rotary motion of the second actuator 122 to linear motion of the first actuator 120.

A rear contact 182 may extend through an opening 190 in the second cover portion 136 of the tail cap assembly 104 and may be coupled to a spring post 180. A battery spring contact 184 may extend through an opening 192 in the second cover portion 136 of the tail cap assembly 104. The rear contact 182 may contact a positive end of the battery 108 and the battery spring 184 may contact a negative end of the battery 108.

According to one aspect there is provided an illuminator having a tail cap assembly and a housing at least partially enclosing at least one battery and a source of illumination. The assembly having a first and a second movable actuator, the first actuator movable between a first position in which a conductor does not complete a circuit with the at least one battery and the source of illumination and a second position in which the conductor does complete the circuit with the at least one battery and the source of illumination. The second actuator moveable from a first position to a second and a third position. The second actuator configured to prevent movement of the first actuator from the first position when the second actuator is in the first position. The second actuator configured to allow movement of the first actuator from the first position to the second position when the second actuator is in the second position. The second actuator configured to maintain the first actuator in the second position when the second actuator is in the third position.

According to another aspect there is provided an illuminator having a housing at least partially enclosing at least one battery, a source of illumination, and a backplate assembly. The backplate assembly having a first and a second movable actuator. The first actuator movable between a first position in which a conductor does not complete a circuit with the at least one battery and the source of illumination and a second position in which the conductor does complete the circuit with the at least one battery and the source of illumination. The second actuator may be moveable from a first position to a second and a third position. When the second actuator is in the first position, the first actuator is prevented from completing the circuit with the at least one battery and the source of illumination, when the second actuator is in the second position, the first actuator is not prevented from completing the circuit with the at least one battery and the source of illumination, and when the second actuator is in the third position, the first actuator completes the circuit.

According to yet another aspect there is provided a method of controlling a light emitter in a flashlight wherein rotating a first actuator about an axis parallel with a longitudinal axis of the flashlight to a first position prevents a second actuator from longitudinal movement; rotating the first actuator about the axis to a second position allows the second actuator to move longitudinal when actuated to cause the light emitter to turn on as long as the actuator is actuated; and rotating the first actuator about the axis to a third position to lock the second actuator in a second position causes the light emitter to turn on and stay on Although several embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not limited thereby

I claim:

1. An illuminator, comprising:

a housing at least partially enclosing at least one battery and a source of illumination;

a tail cap assembly removably securable to the housing, the assembly having a first and a second movable actuator, the first actuator movable between a first position in which a conductor does not complete a circuit with the at least one battery and the source of illumination and a second position in which the conductor does complete the circuit with the at least one battery and the source of illumination; the second actuator moveable from a first position, to a second and a third position, the second actuator configured to prevent movement of the first actuator from the first position when the second actuator is in the first position, the second actuator configured to allow movement of the first actuator from the first position to the second position when the second actuator is in the second position, and the second actuator configured to prevent movement of the first actuator from the second position when the second actuator is in the third position.

2. The illuminator of claim 1, wherein the first actuator is linearly translatable along an axis parallel to a longitudinal axis of the housing.

3. The illuminator of claim 1, wherein the second actuator is rotatable about an axis parallel to a longitudinal axis of the housing.

4. The illuminator of claim 1, wherein the tail cap assembly further comprises a retainer pivotable about an axis generally perpendicular to a longitudinal of the housing for securing the tail cap to the housing.

5. The illuminator of claim 1, wherein rotation of the second actuator rotates a cam which in turn moves an electrical conductor into series contact with the battery.

6. The illuminator of claim 1, wherein rotation of the second actuator rotates a cam which urges the first actuator from the first position to the second position.

7. The illuminator of claim 1, wherein a user can selectively couple the at least one battery to the source of illumination by moving the first actuator from the first position to the second position when the second actuator is in the second position.

8. The illuminator of claim 1, wherein the first actuator is configured to selectively control an on/off status of the source of illumination.

9. The illuminator of claim 1, wherein the source of illumination is a selected one of an incandescent bulb and a light emitting diode.

10. An illuminator, comprising:

a housing at least partially enclosing at least one battery and a source of illumination;

a back plate assembly removably securable to the housing, the backplate assembly having a first and a second movable actuator, the first actuator movable between a first position in which a conductor does not complete a circuit with the at least one battery and the source of illumination and a second position in which the conductor does complete the circuit with the at least one battery and the source of illumination; the second actuator moveable from a first position to a second and a third position, when the second actuator is in the first position, the first actuator is prevented from completing the circuit with the at least one battery and the source of illumination, when the second actuator is in the second position, the first actuator is not prevented from completing the circuit with the at least one battery and the source of illumination, and when the second actuator is in the third position, the first actuator is prevented from movement from maintained in the second position.

11. The illuminator of claim 10, wherein the first actuator is translatable about an axis parallel to a longitudinal axis of the housing.

12. The illuminator of claim 10, wherein the second actuator is rotatable about an axis parallel to a longitudinal axis of the housing.

13. The illuminator of claim 10, wherein the back plate tail cap assembly further comprises a retainer pivotable about an axis generally perpendicular to a longitudinal of the housing for securing the tail cap to the housing.

14. The illuminator of claim 10, wherein rotation of the second actuator rotates a cam which in turn moves an electrical conductor into series contact with the battery.

15. The illuminator of claim 10, wherein rotation of the second actuator rotates a cam which urges the first actuator from the first position to the second position.

16. The illuminator of claim 10, wherein a user can selectively couple the at least one battery to the source of illumination by moving the first actuator from the first position to the second position when the second actuator is in the second position.

17. The illuminator of claim 10, wherein the first actuator is configured to selectively control an on/off status of the source of illumination.

18. The illuminator of claim 1, wherein the source of illumination is a selected one of a incandescent bulb and a light emitting diode.

19. A method of controlling a light emitter in a flashlight, comprising the steps of:

rotating a first actuator about an axis parallel with a longitudinal axis of the flashlight to a first position to prevent a second actuator from longitudinal movement;

rotating the first actuator about the axis to a second position to allow the second actuator to move longitudinal when actuated to cause the light emitter to turn on as long as the actuator is actuated; and rotating the first actuator about the axis to a third position to lock the second actuator in a second position to cause the light emitter to turn on and stay on.

20. The method of claim 19, wherein the second actuator when actuated is translated along an axis parallel to the rotational axis of the first actuator.

* * * * *

UNITED STATES PATENT AND TRADEMARK OFFICE

CERTIFICATE OF CORRECTION

PATENT NO. : 7,922,350 B1
APPLICATION NO. : 12/117017
DATED : April 12, 2011
INVENTOR(S) : Siu It is certified that error appears in the above-identified patent and that said Letters Patent is hereby corrected as shown below:

Column 6, line 20, delete words “maintained in”

Column 6, line 27, delete word “tail”

Column 6, line 28, delete word “cap”

Signed and Sealed this
Fourteenth Day of June, 2011

David J. Kappos

David J. Kappos
*Director of the United States Patent and Trademark Office*